US005435121A

United States Patent [19]

Cobb

[11] Patent Number: 5,435,121

[45] Date of Patent: Jul. 25, 1995

[54] YARN LAP PREVENTOR FOR A TAKE-UP SHAFT IN AN OPEN END SPINNING MACHINE AND ASSOCIATED METHOD

[75] Inventor: Kenneth A. Cobb, Eden, N.C.

[73] Assignee: D E Williams Company, Charlotte, N.C.

[21] Appl. No.: 115,934

[22] Filed: Sep. 1, 1993

Related U.S. Application Data

[63] Continuation-in-part of Ser. No. 887,306, May 22, 1992.

[51] Int. Cl.[6] ..... B65H 57/00

[52] U.S. Cl. ..... 57/400; 57/352; 19/262

[58] Field of Search ..... 57/300, 301, 302, 303, 57/304, 305, 306, 352, 400, 404, 406, 407; 242/35.6 R, 18 R, 18 DD; 226/18; 19/262, 264, 265

[56] References Cited

U.S. PATENT DOCUMENTS

| | | |
|---|---|---|
| 901,784 | 10/1908 | Cordingley . |
| 1,454,316 | 5/1923 | Dover . |
| 2,006,055 | 6/1993 | McKean . |
| 2,096,923 | 10/1937 | Schwehn et al. . |
| 2,789,774 | 11/1953 | Petersen et al. . |
| 3,590,733 | 7/1971 | Gammeter . |
| 3,924,397 | 12/1925 | Stahlecker et al. . |
| 3,981,085 | 8/1976 | Franko . |
| 4,065,120 | 12/1977 | Imaizuma et al. . |
| 4,090,676 | 5/1978 | Yano et al. . |
| 4,586,212 | 5/1987 | Gasser . |
| 4,785,507 | 11/1988 | Miyazaki et al. . |
| 4,819,302 | 4/1989 | Fukuda et al. . |

*Primary Examiner*—Clifford D. Crowder
*Assistant Examiner*—Larry D. Worrell, Jr.
*Attorney, Agent, or Firm*—Bell, Seltzer, Park & Gibson

[57] ABSTRACT

A yarn lap preventor for deflecting a parted yarn end away from an enlarged diameter area of a rotating take-up shaft of the open end spinning machine, particularly of the type for forming cylindrical yarn packages. The yarn lap preventor is preferably integrally molded plastic including a body portion and a mounting arm portion extending radially outwardly from the body portion. The body portion of the yarn lap preventor includes a tapered edge which is positioned adjacent the enlarged diameter area of the take-up shaft and preferably in closely spaced apart relation from where the advancing yarn leaves the enlarged diameter area. The body portion of the yarn lap preventor also preferably includes a shield portion which extends along a circumferential portion of the enlarged diameter area.

18 Claims, 1 Drawing Sheet

YARN LAP PREVENTOR FOR A TAKE-UP SHAFT IN AN OPEN END SPINNING MACHINE AND ASSOCIATED METHOD

RELATED APPLICATION

This application is a continuation-in-part of U.S. patent application Ser. No. 07/887,306 filed May 22, 1992.

FIELD OF THE INVENTION

The invention relates to the field of textile yarn production and, more particularly, to a device and method for reducing yarn lap on an open end spinning machine.

BACKGROUND OF THE INVENTION

A typical open end spinning machine, such as the AUTOCORO ® rotor spinning machine available from Schlafhorst having an office in Charlotte, N.C., includes a series of individual open end spinning positions on both sides of an elongate machine frame. At each spinning position, sliver is drawn from a supply can and into a rotor or open end spinning area. The spun yarn is engaged and moved by a rotating take-up shaft and cooperating cot, and is wound by a drive roll to form a conical yarn package.

The spinning positions on each side of the open end spinning machine share several common operating components. Among the common components is a rotating take-up shaft. At each spinning position, the take-up shaft has an enlarged diameter area for engaging and advancing yarn from the open end spinning area. The advancing yarn is typically directed in a reciprocal motion back and forth over the enlarged diameter area to more evenly distribute wear.

One type of conventional open end spinning machine produces conical yarn packages, and, accordingly, includes a mechanism for maintaining uniform tension of the yarn, as well as a traverse bar for directing the advancing yarn in the reciprocating motion across the enlarged area of the take-up shaft. Another common conventional spinning machine produces cylindrical yarn packages, and, hence, does not have the tension controlling mechanism as in the machine for making conical yarn packages.

When a yarn parts on an open end spinning machine, such as downstream from the take-up shaft, it is likely to wrap around and form an entangled mass, that is, a yarn lap, on the enlarged diameter area of the take-up shaft. The yarn lap forms in the time before the movement of the yarn is fully ceased as caused by operation of a stop motion. Due to the loss in production time that would result if the common take-up shaft were stopped to remove a yarn lap at only a single position, the yarn lap is instead typically manipulated to the side of the enlarged diameter area of the take-up shaft by the machine operator while the shaft continues to rotate.

A number of such yarn laps on the take-up shaft may accumulate at each position before the open end spinning machine is shut down for other scheduled maintenance and all of the accumulated yarn laps may then be completely removed from the take-up shaft. Unfortunately, an accumulation of yarn laps may require that the open end spinning machine be operated at a reduced speed, thereby resulting in decreased production efficiency. In addition, the accumulated yarn laps present a potential fire hazard.

It is known that the tendency of the yarn to part may be reduced to thereby reduce the occurrence of yarn laps between scheduled maintenance activities. For example, the use of 100% cotton, rather than a blend, may reduce the likelihood of yarn breakage; however, it is the customer who ordinarily dictates the types of yarns to be produced. In addition, unsatisfactory attempts have been made to more precisely control the tension of the moving yarn to thereby reduce the number of yarn partings. Alternatively, the speed of the open end spinning machine may also be reduced to reduce fluctuations in yarn tension which may cause yarn partings.

Unfortunately, previous attempts to more precisely control yarn tension have proven unsuccessful and fail to address the problem of the accumulation of yarn laps resulting from parted yarns. In other words, controlling the yarn tension is not effective once a parting of the yarn has occurred. Reducing the speed of the spinning machine reduces production efficiency and is, thus, also undesirable. In addition, any proposed solution for preventing yarn laps would desirably take into account the substantial investment in open end spinning machines and, accordingly, a solution must be compatible with these existing machines. Moreover, the area of an open end spinning machine adjacent the enlarged diameter area of the rotating take-up shaft provides only very limited clearances between existing fixed and moving components.

SUMMARY OF THE INVENTION

It is therefore an object of the invention to provide a yarn lap preventor and an associated method for preventing yarn laps on the take-up shaft of an open end spinning machine, particularly an open end spinning machine of the type for producing cylindrical yarn packages.

It is another object of the present invention to provide a yarn lap preventor and associated method that may be readily retrofitted to an existing open end spinning machine, particularly an open end spinning machine of the type for producing cylindrical yarn packages.

These and other objects, features and advantages of the present invention are provided by a yarn lap preventor mounted on a wall of an open end spinning machine, wherein the yarn lap preventor includes a body portion closely associated with an enlarged diameter area of a take-up shaft of an open end spinning machine. The body portion is carried by the open end spinning machine for deflecting a parted yarn away from the enlarged diameter area to prevent the formation of a yarn lap thereon. In other words, the yarn lap preventor serves as deflection means for deflecting a parted yarn away from the enlarged diameter area of the rotating take-up shaft.

The open end spinning machine preferably has open end spinning means for forming yarn from sliver, and take-up means downstream from the open end spinning means for advancing yarn therefrom to form a yarn package. For example, the open end spinning machine may be of the type manufactured and sold by Schlafhorst having multiple spinning positions on each side of the machine, and wherein a common take-up shaft is provided for the spinning positions on each side of the machine.

The take-up means of the open end spinning machine preferably includes the rotating take-up shaft with the enlarged diameter area, and guide means for directing the yarn in contact with a predetermined first, or lower, portion of the enlarged diameter area. The guide means preferably includes a rotating cot positioned opposite a lower portion of the enlarged diameter area of the take-up shaft and which defines a nip with the enlarged area for engaging and advancing the yarn from the open end spinning means.

The open end spinning machine may be of the type typically used for producing cylindrical yarn packages, and, accordingly, also preferably includes a wall extending adjacent and transverse to the enlarged diameter area of the take-up shaft. In the parent application, Ser. No. 07/887,306 filed on May 22, 1992, a preferred embodiment of a yarn lap preventor is disclosed for installation on the traverse bar of an open end spinning machine of the type commonly used for producing conical yarn packages. As would be readily understood by those skilled in the art, the yarn lap preventor of the present invention may also be readily used in combination with any type of open end spinning machine having a wall portion extending outwardly from the open end spinning means and transverse to the enlarged diameter area take-up shaft.

The body portion of yarn lap preventor preferably has a tapered leading edge extending lengthwise adjacent the enlarged diameter area of the take-up shaft. Moreover, the leading edge is preferably positioned in closely spaced apart relation from a departure area where the advancing yarn leaves the enlarged diameter area. Accordingly, a parted yarn is deflected away from the enlarged diameter area before it can travel any significant distance around the enlarged diameter area.

The body portion of the yarn lap preventor also preferably includes a shield portion extending lengthwise along substantially the entire length of the enlarged diameter area of the take-up shaft and covering a predetermined circumferential portion of the enlarged diameter area. The shield portion thus serves to shield the enlarged diameter area from a parted yarn to further reduce the likelihood of a yarn lap being formed.

The yarn lap preventor also includes a mounting arm portion connected to the body portion and extending radially outwardly therefrom. The mounting arm and body portions of the yarn lap preventor are preferably formed of integrally molded rigid plastic. The mounting arm portion has a free end with an opening therethrough. A fastener may be secured through the opening in the free end of the mounting arm portion to thereby secure the yarn lap preventor to the wall of the open end spinning machine.

The body portion of the yarn lap preventor is also preferably arcuate with a radius of curvature slightly greater than a radius of the enlarged diameter area of the take-up shaft. The arcuate shape provide greater compactness for the yarn lap preventor. In addition, once the free end of the base mounting portion is mounted to the wall of the open end spinning machine, the body portion may be rotated to permit precise positioning of a forward portion of the body portion closer to the enlarged diameter area of the take-up shaft than the rearward portion, while still having sufficient clearance from adjacent components of the open end spinning machine.

A method aspect of the present invention is for preventing a yarn lap from accumulating on the rotating take-up shaft of an open end spinning machine, particularly on the type of open end spinning machine for making a cylindrical yarn package. More particularly, the method includes the steps of providing a yarn lap preventor as described above, mounting a free end of the mounting arm portion to a wall of the open end spinning machine, and rotatably positioning the yarn lap preventor so that a forward portion of the body portion is closely associated with the enlarged diameter area of the take-up shaft.

The method preferably also includes the step of fixedly securing the free end of the mounting arm portion to the wall of the open end spinning machine after the forward portion is positioned in close association with the enlarged diameter area of the take-up shaft. In addition, the step of mounting the free end of the yarn lap preventor preferably includes mounting same so that the leading edge is adjacent a departure area of the advancing yarn from the enlarged diameter area of the take-up shaft.

DETAILED DESCRIPTION OF PREFERRED EMBODIMENTS

Figures 1, 2, 3, 4, 5, 6:
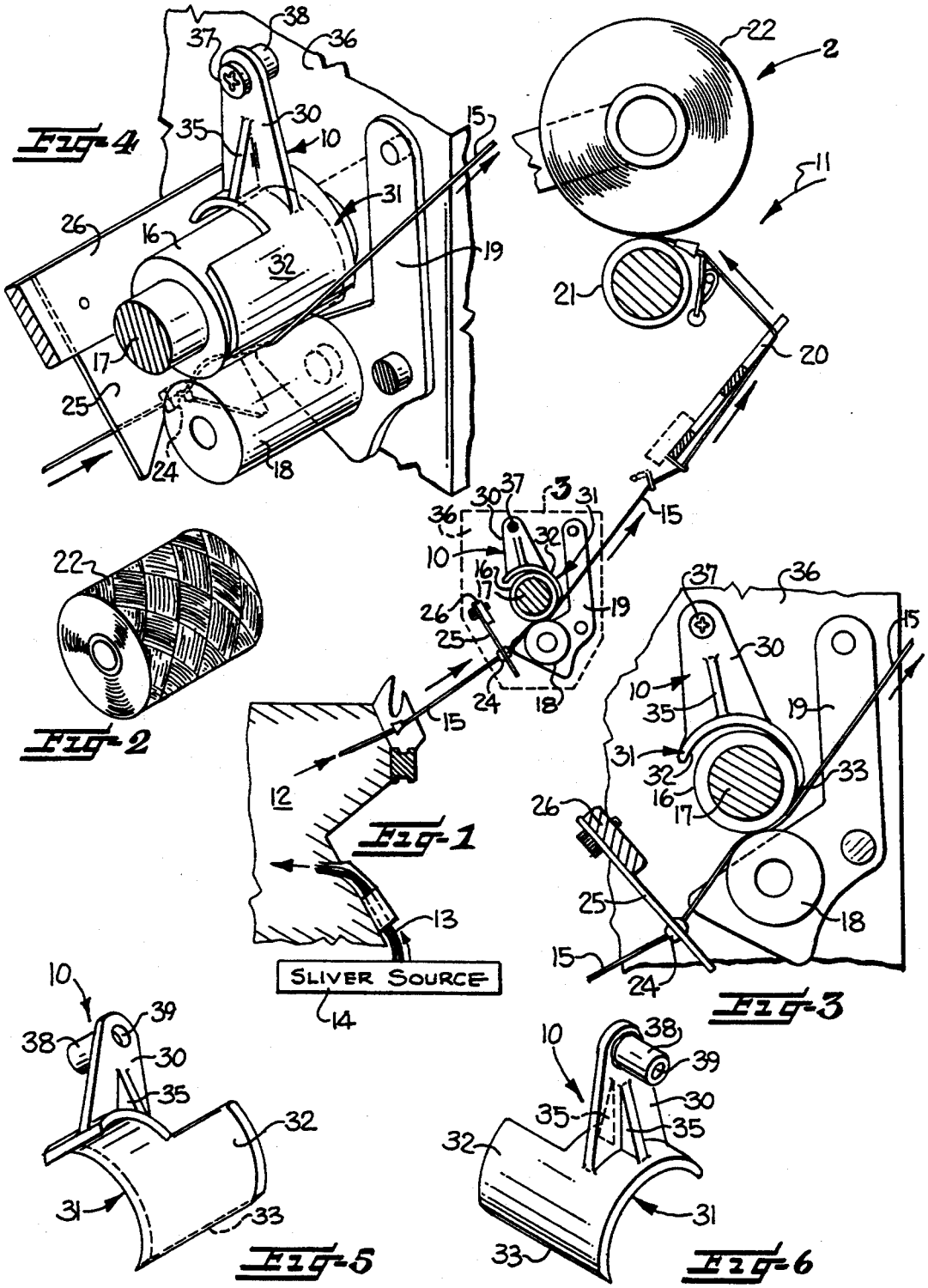
FIG. 1 is a schematic cross-sectional view of a position on an open end spinning machine for producing cylindrical yarn packages and including the yarn lap preventor according to the present invention.
FIG. 2 is a perspective view of a cylindrical yarn package produced by the open end spinning machine viewed from arrow 2 in FIG. 1.
FIG. 3 is a greatly enlarged side view of a portion of the open end spinning position as shown within the dotted lines of FIG. 1 illustrating the yarn lap preventor according to the invention.
FIG. 4 is a perspective view of the portion of the open end spinning position as shown in FIG. 3.
FIG. 5 is a greatly enlarged perspective view of an underside of the yarn lap preventor according to the invention.
FIG. 6 is a greatly enlarged perspective view of a topside of the yarn lap preventor according to the invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, Applicant provides this embodiment so that this disclosure will be thorough and complete, and will fully convey the scope of the invention to those skilled in the art. Like numbers refer to like elements throughout.

The yarn lap preventor 10 according to the present invention is shown installed in an open end spinning machine position 11 in FIG. 1. As will be readily understood by those having skill in the art, an open end spinning machine typically includes a series of such spinning positions 11 on both sides of the machine. Accordingly, the yarn lap preventor 10 is advantageously installed at each position 11 on the open end spinning machine.

The illustrated embodiment of the yarn lap preventor 10 is preferably installed on an open end spinning machine of the type such as manufactured and sold by Schlafhorst for producing cylindrical yarn packages 22 (FIG. 2). The illustrated embodiment of the yarn lap preventor 22 is similar to a yarn lap preventor disclosed in the parent application, Ser. No. 07/887,306, filed May 22, 1992, assigned to the assignee of the present invention. The parent application discloses a yarn lap preventor for installation on an open end spinning machine of the type as also manufactured by Schlafhorst, but for making conical yarn packages. The entire disclosure of the parent application, Ser. No. 07/887,306, filed on May 22, 1992, is hereby incorporated herein by reference.

As would readily be understood by those skilled in the art, an open end spinning position 11 of an open end spinning machine includes a yarn spinning area 12 for receiving sliver 13 from a sliver source 14 and then spinning the fibers into a yarn 15. In other words, the yarn spinning area 12 serves as open end spinning means for forming yarn 15 from sliver 13

Take-up means is provided downstream from the spinning area 12 for advancing yarn 15 therefrom to form a cylindrical yarn package 22 as in the illustrated embodiment. More particularly, the yarn 15 from the yarn spinning area 12 is guided over an enlarged diameter area 16 of a rotating take-up shaft 17 between the nip formed by the enlarged diameter area and an opposing rotating cot 18 carried by a mounting arm 19. The yarn 15 is directed through a conventional winding mechanism 20, and wound to form a cylindrical yarn package 22 by a conventional drive roll 21. The cylindrical yarn package 22, as would be readily understood by those skilled in the art, has a substantially uniform diameter along its length as shown in FIG. 2.

The yarn 15, as it is advanced from the yarn spinning area 12, is moved in a reciprocal motion back and forth across the enlarged diameter area 16 of the rotating take-up shaft 17 by a yarn guide eyelet 24 attached to a mounting plate 25 to more evenly distribute wear caused by the moving yarn, as would be readily appreciated by those skilled in the art. The yarn guide eyelet mounting plate 25 is connected to a traverse bar 26 which extends along the length of the open end spinning machine and moves in a reciprocal motion thereby serving all of the respective spinning positions 11 therealong.

As would be readily understood by those skilled in the art, the rotating take-up shaft 17 also typically serves all of the spinning positions 11 on a given side of the open end spinning machine and has a respective enlarged diameter area 16 for each position. Thus, it is not typically feasible to stop the take-up shaft 17 because of a single parted yarn; rather, automatic splicing equipment is used to restore the parted yarn. Unfortunately, before the present invention, a parted yarn end would readily wrap around the enlarged diameter area 16 of the rotating take-up shaft 17 and form a yarn lap. The yarn lap would typically be manually pulled to an adjacent area of the take-up shaft 17 by an operator. Yarn laps thus accumulated on the take-up shaft and presented a potential fire hazard.

Referring now to FIGS. 3–6, the yarn lap preventor 10 and its functions will be more fully explained. The yarn lap preventor 10 includes a mounting arm portion 30 and an arcuate body portion 31 connected thereto. The mounting arm portion 30 and body portion 31 of the yarn lap preventor 10 are preferably formed as an integrally molded unit of a rigid plastic material, such as Nylon 66, which is readily molded yet durable in service. In the illustrated embodiment, the mounting arm portion 30 extends radially outwardly from the arcuate body portion 31 to facilitate positioning of the yarn lap preventor 10 within the relatively tight confines of a typical open end spinning machine of the type used for producing cylindrical yarn packages 22 (FIG. 2) as discussed above.

The body portion 31 of the yarn lap preventor 10 preferably includes a tapered leading edge 33 positioned to extend along substantially the entire length of the enlarged diameter area 16 of the take-up shaft 17. Moreover, the leading edge 33 is preferably positioned in close spaced apart relation from a departure area where the advancing yarn 15 leaves the enlarged diameter area 16. Thus, the tapered leading edge 33 serves to deflect a parted yarn end away from the enlarged diameter area 16 of the take-up shaft 17. In addition, the body portion 31 also preferable includes a shield portion 32 extending along substantially the entire length of the enlarged diameter area 16 and covers a predetermined circumferential portion of the enlarged diameter area 16. In the illustrated embodiment, the shield portion 32 covers about $\frac{1}{4}$ to $\frac{1}{3}$ of the circumference of the enlarged diameter area 16 of the take-up shaft 17. Thus, the shield portion 32 further serves to prevent a parted yarn end from wrapping around the enlarged diameter area 16 of the take-up shaft 17.

Upon parting of a yarn, a parted yarn end would continue to move before a stop motion could sense the parting and stop the movement of the yarn. In addition, the take-up shaft 17 continues to rotate even upon parting of a yarn. Thus, without the yarn lap preventor 10 according to the invention, a parted yarn end would wrap around the enlarged diameter area 16 of the rotating take-up shaft 17, be pulled to the side by an operator, and left to accumulate until the next scheduled periodic maintenance for the open end spinning machine.

As shown best in FIGS. 3 and 4, the mounting arm portion 30 of the yarn lap preventor 10 according to the invention is connected to the wall 36 of the open end spinning machine so that the tapered edge 33 is positioned in contacting relation or in closely spaced apart relation from the enlarged diameter area 16 of the rotating take-up shaft 17. As would be readily understood by those having skill in the art, the tapered edge 33 may initially be positioned in lightly contacting relation with the enlarged diameter area 16 and be abraded by frictional contact therewith resulting in the edge being positioned in closely spaced apart relation. Alternately, the tapered edge 33 may initially be positioned in closely spaced apart relation so that a parted yarn end does not pass between the enlarged diameter area 16 and the tapered edge, but rather is deflected by the tapered edge.

The mounting arm portion 30 of the yarn lap preventor 10 preferably includes a pair of integrally molded reinforcing ribs 35 (FIGS. 5 and 6). In addition, the mounting arm portion 30 includes an integrally molded tubular spacer 38 at the free end thereof. The tubular spacer 38 has an opening extending therethrough for facilitating mounting of the yarn lap preventor 10 to the wall 36 by a fastener, such as a screw 37, extending through the opening and being secured to the wall of the open end spinning machine.

The body portion 31 of the yarn lap preventor 10 also preferably has a radius of curvature slightly larger than the radius of curvature of the enlarged diameter area 16 of the take-up shaft. Accordingly, another aspect of the present invention is that the free end of the mounting arm portion 30 may be initially rotatably secured to the wall by the mounting screw 37. Then the yarn lap preventor 10 may then be rotated so that a forward portion or leading edge 33 is closely associated with the enlarged diameter area 16 of the take-up shaft 17. Thus, the rearward portion is spaced from an adjacent portion of the enlarged diameter area 16 (FIG. 3). When the yarn lap preventor 10 is properly positioned, the screw 37 can be tightened to fixedly secure the yarn lap preventor to the wall 36 of the open end spinning machine.

The yarn lap preventor 10 according to the invention is a mechanically uncomplicated device that is sufficiently compact and so designed as to be readily retrofitted to a conventional open end spinning machine, particularly for open end spinning machines of the type for making cylindrical yarn packages. Accordingly, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An open end spinning machine comprising:

open end spinning means for forming yarn from sliver;

take-up means downstream from said open end spinning means for advancing yarn therefrom to form a yarn package, said take-up means comprising a rotating take-up shaft having an enlarged diameter area and guide means for directing the yarn from said open end spinning means and contacting a lower portion of the enlarged diameter area of said take-up shaft;

a wall extending outwardly from said open end spinning means and transverse to said enlarged diameter area of said take-up shaft; and yarn deflection means mounted on said wall for deflecting a broken yarn away from the enlarged diameter area of the take-up shaft to prevent formation of a yarn lap thereon, said deflection means comprising a body portion adjacent an upper portion of the enlarged diameter area of said take-up shaft.

2. An open end spinning machine according to claim 1 wherein said body portion of said deflection means has a leading edge extending lengthwise adjacent the enlarged diameter area of said take-up shaft, and wherein said leading edge is positioned in closely spaced apart relation from a departure area where the advancing yarn leaves the enlarged diameter area of said take-up shaft.

3. An open end spinning machine according to claim 2 wherein said leading edge of said body portion is tapered.

4. An open end spinning machine according to claim 1 wherein said body portion of said deflection means has a radius of curvature greater than a radius of the enlarged diameter area of the take-up shaft.

5. An open end spinning machine according to claim 4 wherein said body portion comprises a forward portion adjacent a departure area where the advancing yarn leaves the enlarged diameter area of said take-up shaft and a rearward portion opposite said forward portion, and wherein said deflection means is mounted so that the forward portion of said body portion is closer to the enlarged diameter area of said take-up shaft than the rearward portion.

6. An open end spinning machine according to claim 1 wherein said body portion of said deflection means includes a shield portion extending lengthwise along substantially the entire length of the enlarged diameter area and covering a predetermined circumferential portion thereof for shielding same from a parted yarn.

7. An open end spinning machine according to claim 1 wherein said deflection means further comprises a mounting arm portion connected to said body portion and extending radially outwardly therefrom, and wherein a free end of said mounting arm portion is connected to said wall.

8. An open end spinning machine according to claim 7 wherein said body portion and said mounting arm portion of said deflection means comprise integrally molded rigid plastic.

9. An open end spinning machine according to claim 1 wherein said guide means comprises a rotating cot positioned opposite the lower portion of the enlarged diameter area of said take-up shaft to define a nip therewith.

10. An open end spinning machine comprising:

open end spinning means for forming yarn from sliver;

take-up means downstream from said open end spinning means for advancing yarn therefrom to form a yarn package, said take-up means comprising a rotating take-up shaft having an enlarged diameter area and guide means for directing the yarn from said open end spinning means and contacting a first portion of the enlarged diameter area of said take-up shaft;

a wall extending adjacent the enlarged diameter area of said take-up shaft; and yarn deflection means mounted on said wall for deflecting a broken yarn away from the enlarged diameter area of the take-up shaft to prevent formation of a yarn lap thereon, said deflection means comprising a body portion adjacent a second portion of the enlarged diameter area of said take-up shaft, said body portion of said deflection means having a leading edge extending lengthwise adjacent the enlarged diameter area of said take-up shaft and being positioned in closely spaced apart relation from a departure area where the advancing yarn leaves the enlarged diameter area of said take-up shaft.

11. An open end spinning machine according to claim 10 wherein said leading edge of said body portion is tapered.

12. An open end spinning machine according to claim 10 wherein said body portion of said deflection means has a radius of curvature greater than a radius of the enlarged diameter area of the take-up shaft.

13. An open end spinning machine according to claim 12 wherein said body portion comprises a forward portion adjacent a departure area where the advancing yarn leaves the enlarged diameter area of said take-up shaft and a rearward portion opposite said forward portion, and wherein said deflection means is mounted so that the forward portion of the body portion is closer to the enlarged diameter area of said take-up shaft than the rearward portion.

14. An open end spinning machine according to claim 10 wherein said body portion of said deflection means includes a shield portion extending lengthwise along substantially the entire length of the enlarged diameter area and covering a predetermined circumferential portion thereof for shielding same from a parted yarn.

15. An open end spinning machine according to claim 10 wherein said deflection means further comprises a mounting arm portion connected to said body portion and extending radially outwardly therefrom, and wherein a free end of said mounting arm portion is connected to said wall.

16. An open end spinning machine according to claim 15 wherein said body portion and said mounting arm portion of said deflection means comprise integrally molded rigid plastic.

17. An open end spinning machine according to claim 10 wherein said guide means comprises a rotating cot positioned opposite the lower portion of the enlarged diameter area of said take-up shaft to define a nip therewith.

18. An open end spinning machine according to claim 10 wherein said wall extends outwardly from said open end spinning means and transverse to said enlarged diameter area of said take-up shaft.

* * * * *